US006328183B1

(12) United States Patent
Coleman

(10) Patent No.: US 6,328,183 B1
(45) Date of Patent: Dec. 11, 2001

(54) MASS FLOW BULK MATERIAL BIN

(76) Inventor: Clarence B. Coleman, 2401 Merced St., San Leandro, CA (US) 94577-4286

( * ) Notice: Subject to any disclaimer, the term of this patent is extended or adjusted under 35 U.S.C. 154(b) by 0 days.

(21) Appl. No.: 09/309,715

(22) Filed: May 11, 1999

(51) Int. Cl.[7] ..... B67D 5/06

(52) U.S. Cl. ..... 222/185.1; 222/462; 222/561; 222/564

(58) Field of Search ..... 222/185.1, 564, 222/561, 153.14, 462; 137/872

(56) References Cited

U.S. PATENT DOCUMENTS

| | | | | |
|---|---|---|---|---|
| 1,696,587 | | 12/1928 | Yarwood . | |
| 2,056,239 | | 10/1936 | Walter . | |
| 2,710,116 | * | 6/1955 | Juzwiak | 222/561 |
| 2,905,364 | * | 9/1959 | Marraffino | 222/564 |
| 3,045,400 | | 7/1962 | Grose . | |
| 3,318,473 | * | 5/1967 | Jones et al. | 222/561 |
| 3,354,918 | | 11/1967 | Coleman . | |
| 3,482,742 | * | 12/1969 | Baehr | 222/564 |
| 3,590,888 | | 7/1971 | Coleman . | |
| 3,704,722 | | 12/1972 | Coleman . | |
| 4,039,062 | * | 8/1977 | Carre et al. | 222/564 |
| 4,532,800 | | 8/1985 | Coleman . | |
| 4,567,920 | * | 2/1986 | Vaananen | 222/564 |
| 4,785,966 | * | 11/1988 | Waltke | 222/561 |
| 4,958,741 | | 9/1990 | Johanson . | |
| 5,069,371 | | 12/1991 | Coleman . | |
| 5,361,945 | | 11/1994 | Johanson . | |
| 5,500,083 | | 3/1996 | Johanson . | |
| 5,617,975 | | 4/1997 | Johanson et al. . | |
| 5,628,873 | | 5/1997 | Johanson et al. . | |
| 5,697,535 | | 12/1997 | Coleman . | |

FOREIGN PATENT DOCUMENTS

| | | |
|---|---|---|
| 195 38 963 A1 | 4/1997 | (DE) . |
| 730516 | 5/1955 | (GB) . |
| 1 278 358 | 6/1972 | (GB) . |
| 11 091 869 | 4/1999 | (JP) . |

OTHER PUBLICATIONS

Patent Abstracts of Japan; Japanese Published Application No. 11091869; Applicant: ASAHI BIRUTO KK; Published Apr. 6, 1999; Japanese Patent Office, Copyright 1999.
Article entitled Binside Scoop published by JR Johanson, Inc. during the Summer of 1993.
Article entitled Secrets of the Diamondback Hopper by JR Johanson, Inc., pp. 2 and 3.

* cited by examiner

*Primary Examiner*—Philippe Derakshani
(74) *Attorney, Agent, or Firm*—James R. Cypher; Charles R. Cypher

(57) ABSTRACT

A bin for storing dry powder bulk material or granules. Bulk material is deposited in an upper section of the bin and is discharged from the bottom of the lower section of the bin. The lower section of the bin is formed with oppositely directed, downwardly sloping walls joined by opposing vertical walls. The downwardly sloping walls, respectively, slope downwardly at an angle greater than the angle of repose of the material or granules in the bin. Disposed in the lower section of the bin is a planar vertical divider wall that is supported by the vertical walls of the lower section. The vertical divider wall has flat surfaces that face, respectively, the oppositely directed, downwardly sloping walls of the lower section for reducing bridging of the dry powder bulk material or granules in the bulk material bin during mass flow of the dry powder bulk material or granules from the upper section through the lower section of the bin.

12 Claims, 4 Drawing Sheets

MASS FLOW BULK MATERIAL BIN

BACKGROUND OF THE INVENTION

The present invention relates in general to bulk material bins and, more particularly, to a mass flow bulk material bin.

Heretofore, bulk material bins for storing, handling and discharging dry powder and granules failed to unload completely without bridging. Vibrators were used in the bulk material bins for dry powder and granules to reduce bridging of the stored dry powder materials and granules during the discharge thereof from the bin.

In the U.S. patent to Johanson et al., U.S. Pat. No. 5,617,975, granted on Apr. 8, 1997, for Chip Feed System, there is disclosed a chip bin for uniformly discharging wood chips therefrom without a vibrator. The apparatus disclosed in the patent to Johanson et al., U.S. Pat. No. 5,617,975, employed a cylindrical bin and a conical transition section disposed below the cylindrical bin. In one embodiment, a baffle having triangular cross-sectional areas is disposed within the conical transition section. In another embodiment, the transition section is formed with triangular-shaped, flat side outer panels. The bins disclosed in the patent to Johanson, U.S. Pat. No. 5,617,975, are intended to address the problem of reliability and maintenance of conventional vibratory discharges and the problems of chip bin pluggage, bridging and channeling.

SUMMARY OF THE INVENTION

An object of the present invention is to provide a bin or container for storing bulk material, such as dry powder material and granules, and to unload the dry powder material and granules from the bin without a vibrator.

Another object of the present invention is to provide a bin or container for storing bulk material, such as dry powder material and granules, and to unload the dry powder material and granules from the bin without the dry powder material or the granules bridging within the bin.

A feature of the present invention is to provide a bulk material bin or container having an upper section and a lower section. The lower section is formed with a discharge compartment having a plurality of vertical walls joined with a downwardly declining sloping wall for discharging bulk material from the bin to reduce bridging of the bulk material within the bin.

A bulk material bin comprising an upper section and a lower section. Bulk material is deposited in the upper section of the bin and is discharged from the bottom of the lower section. The upper section of the bin is formed with rectangular cross-sectional areas. Bulk material passes freely from the upper section into the lower section. The lower section of the bin is formed with oppositely directed, downwardly, declining sloping walls joined by opposing vertical walls. Disposed in the lower section of the bin is a vertical, flat wall that engages the opposing vertical walls of the lower section and has the opposing vertical, flat surfaces thereof facing, respectively, the oppositely directed, downwardly declining sloping walls of the lower section for reducing bridging of the bulk material in the bulk material bin.

DESCRIPTION OF THE PREFERRED EMBODIMENTS

Figure 1:
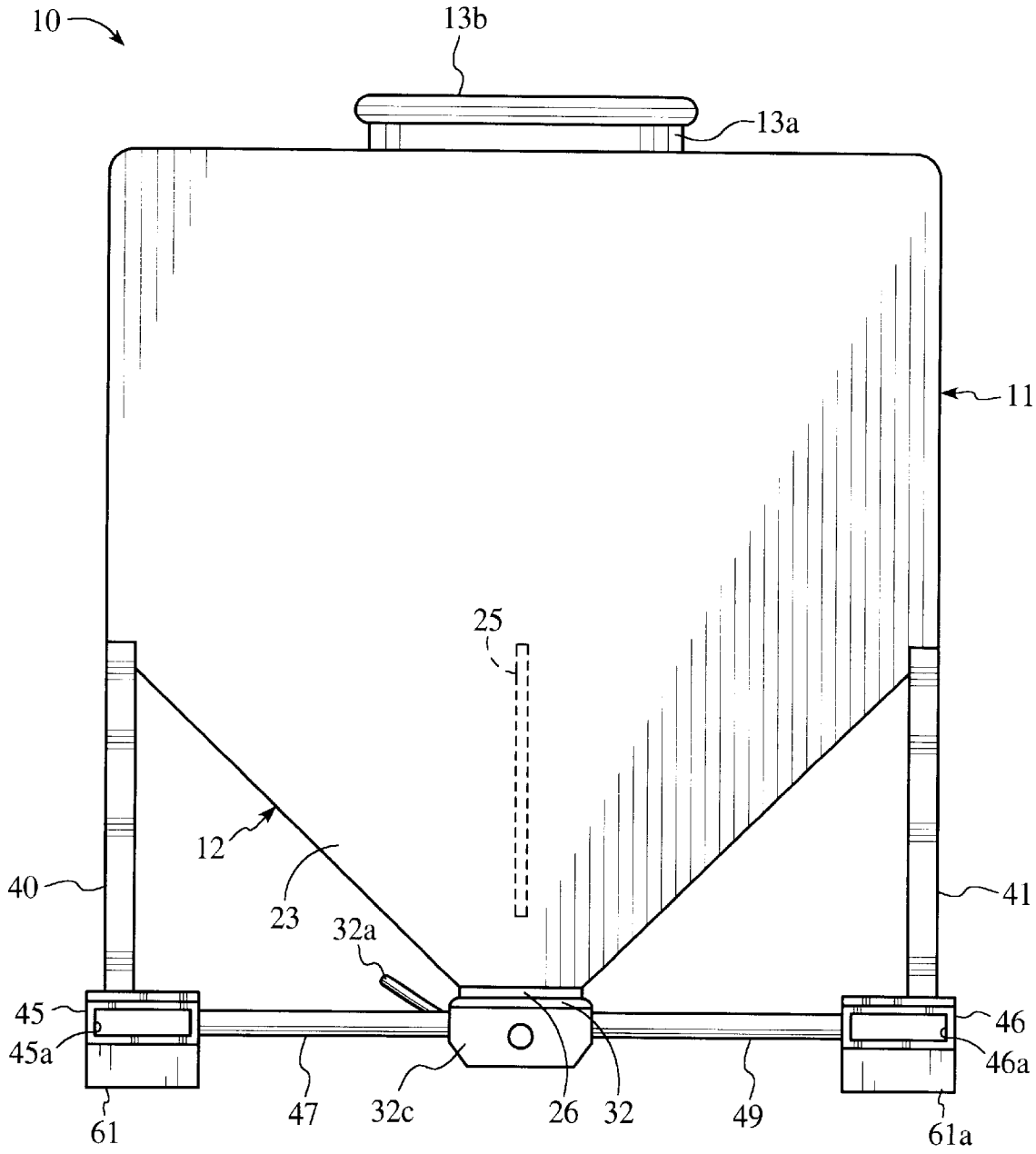
FIG. 1 is a front elevation view of the bulk material bin embodying the present invention.
Figure 2:
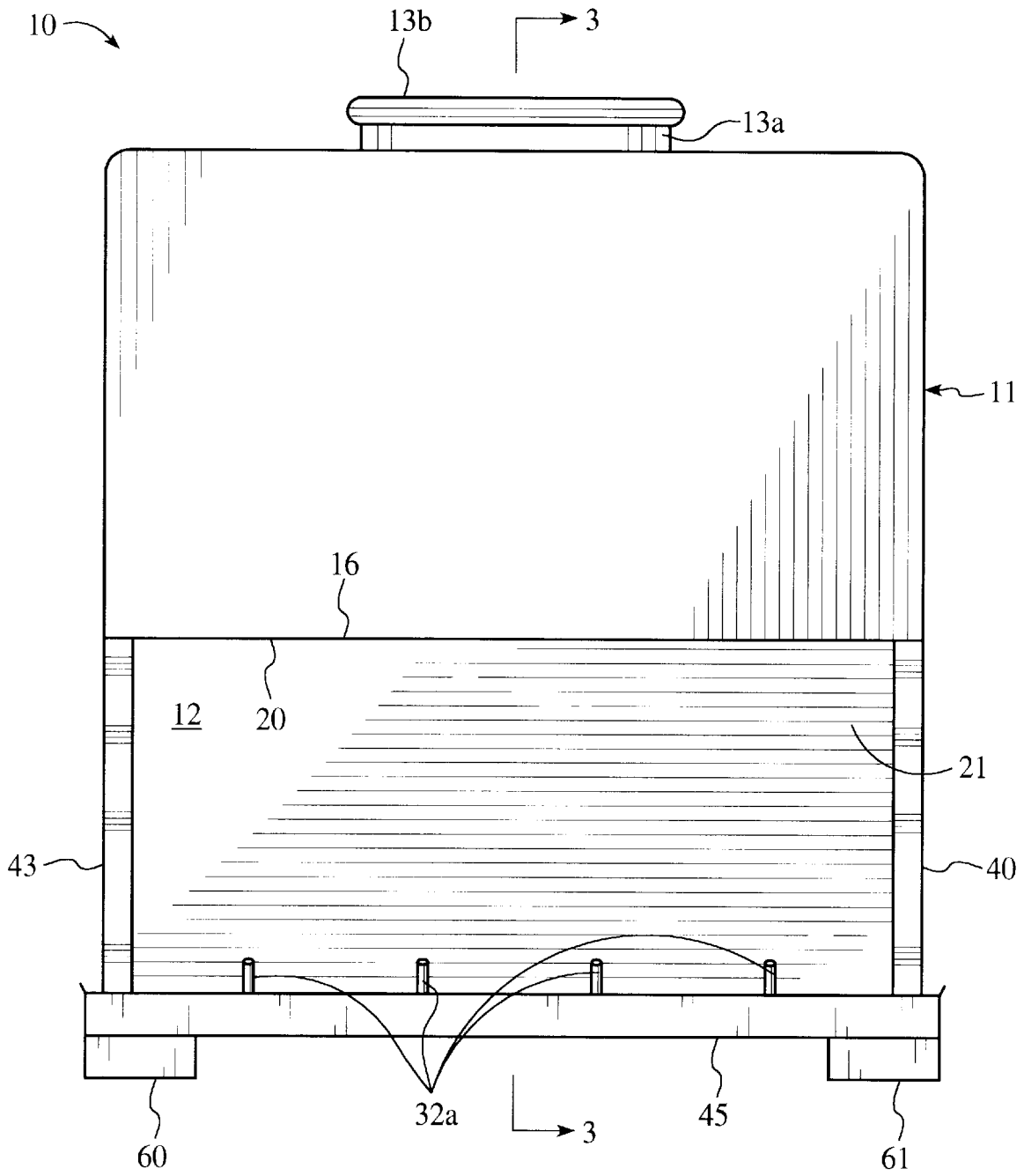
FIG. 2 is a side elevation view of the bulk material bin shown in FIG. 1.

Illustrated in FIGS. 1–4 is a bulk material bin or container 10 embodying the present invention. In the exemplary embodiment, the bulk material is a dry powder material or granules. The bin 10 has an upper hollow section or shell 11 and a lower hollow section or hopper 12. The upper section 11 is made of suitable material, such as stainless steel. An upper horizontal wall 13 of the upper section 11 is formed with a circular opening 14 (FIG. 3) through which bulk material is deposited into the upper section 11. A suitable cylindrically-shaped cover 15 (FIGS. 3 and 4) is removably secured to a cylindrically-shaped neck 13*a* of the upper horizontal wall 13 for the opening and closing of the opening 14. In the examplary embodiment, the cover 15, during closure of the opening 14, forms a seal with the neck 13*a* of the upper horizontal wall 13. Toward this end, the neck 13*a* is welded to the upper horizontal wall 13 of the upper section 11. The perimeter of the neck 13*a* has an arcuate cross-sectional area. Similarly, the perimeter of the cover 15 has an arcuate cross-sectional area that seats in sealing engagement with the perimeter of the neck 13*a*. A suitable lock ring 13*b* (FIGS. 1, 2 and 4) secures the cover 15 to the neck 13*a* of the upper section 11. A suitable seal 15*a* fixed to the underside of the perimeter of the cover 15 is disposed in sealing engagement with the perimeter of the neck 13*a* when the cover 15 closes the circular opening 14 of the upper horizontal wall 13 of the upper section 11.

In the preferred embodiment, the upper section 11 has four upright walls (FIGS. 1–4) joining at right angles. The horizontal cross-sectional areas of the upper section 11 are rectangular. The lower edge 16 of the upper section 11 has a rectangular configuration.

Figure 3:
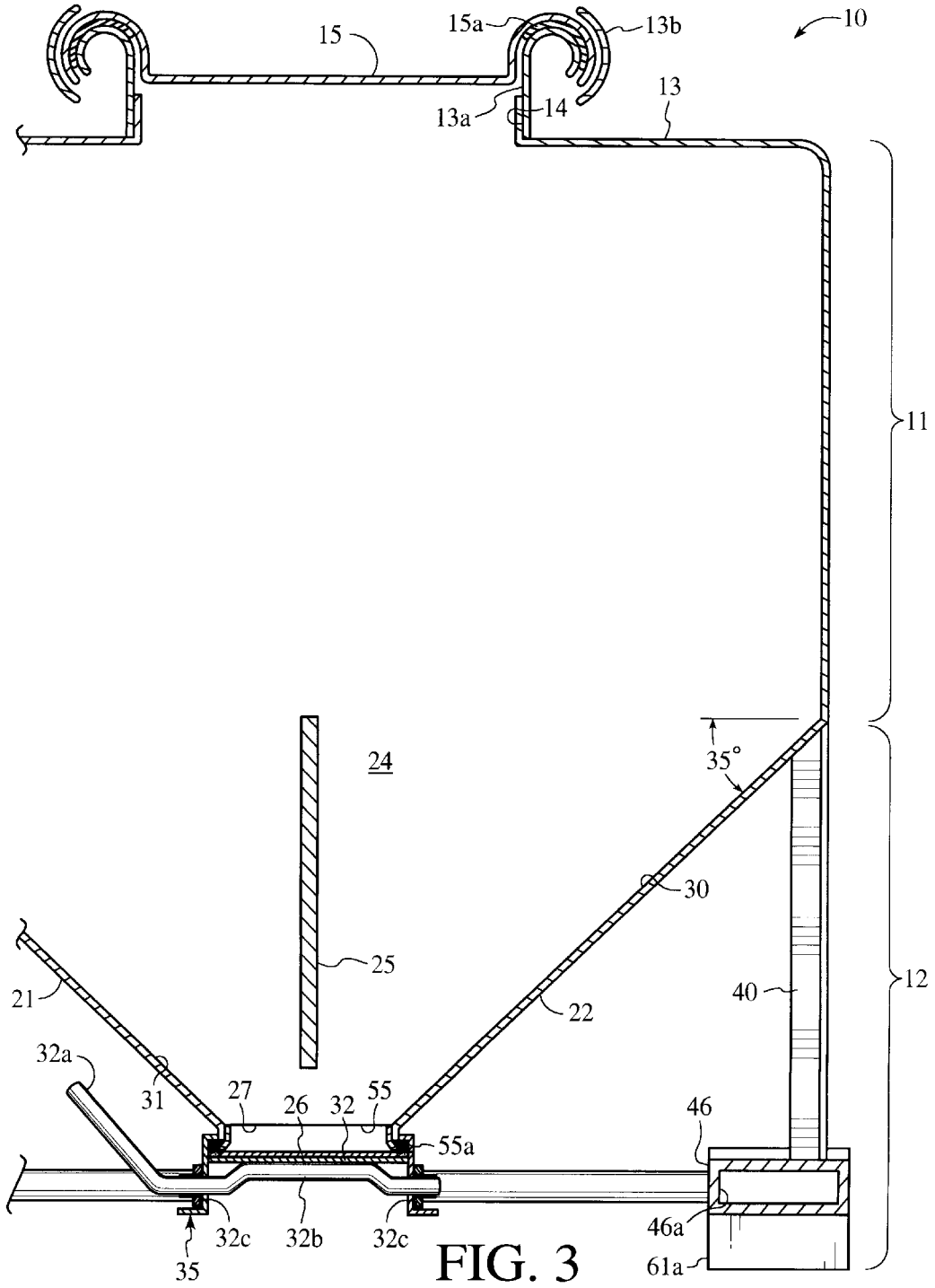
FIG. 3 is an enlarged vertical section view of the bulk material bin shown in FIGS. 1 and 2 taken along line 3—3 of FIG. 2.
Figure 4:
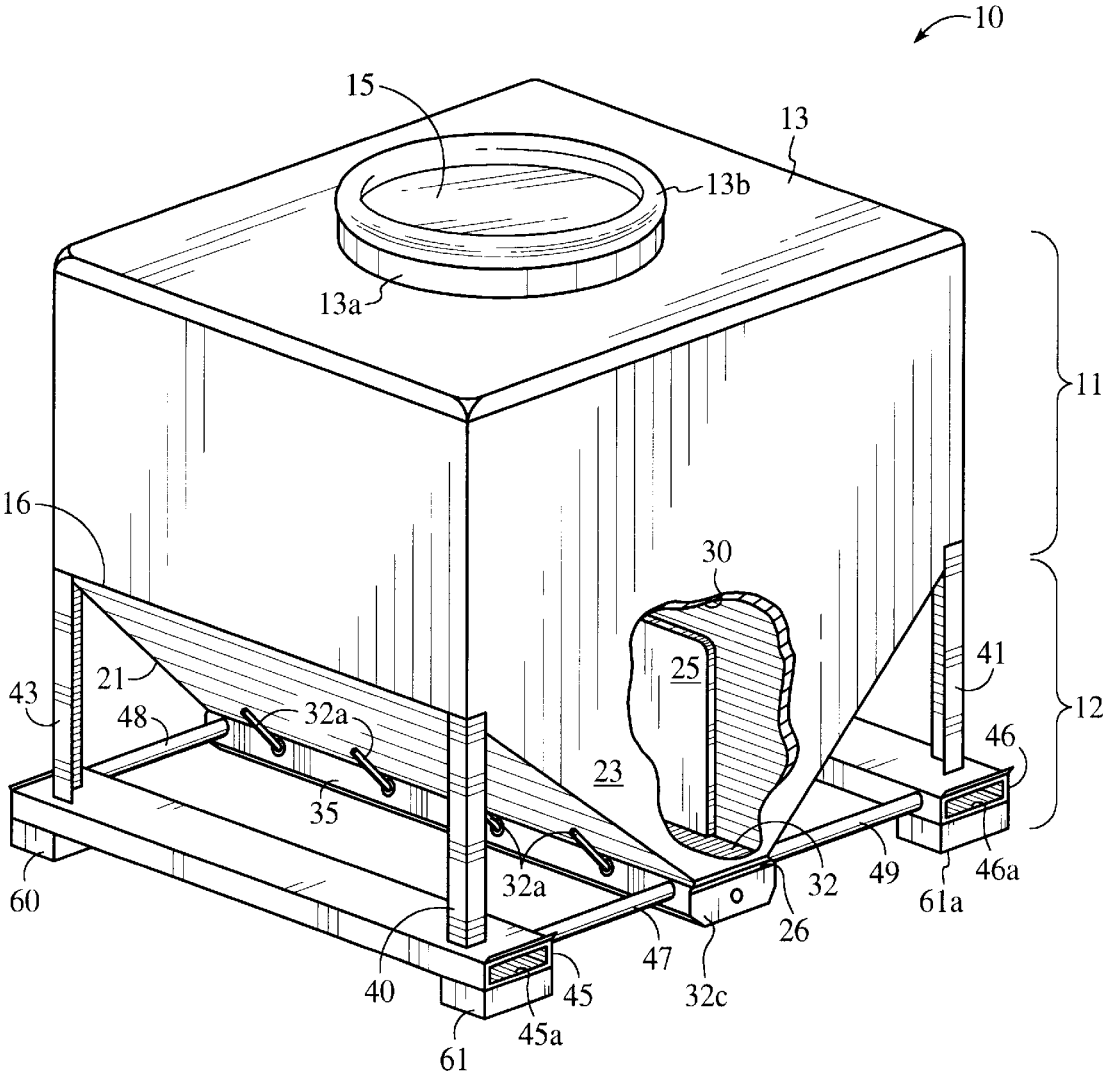
FIG. 4 is a perspective view of the bulk material bin shown in FIGS. 1–3 and broken away to illustrate compartments of the lower section of the bulk material bin having downwardly declining sloping walls joined by opposing vertical walls and a vertical divider having opposing flat vertical surfaces facing, respectively, the opposing downwardly declining sloping walls for reducing bridging of bulk material in the bulk material bin.

The lower section 12 is made of suitable material, such as stainless steel. The lower section 12 comprises oppositely directed, downwardly declining sloping walls 21 and 22 (FIGS. 2, 3 and 4) joining opposing vertical walls 23 and 24 (FIGS. 1, 3 and 4). The sloping of the walls 21 and 22 is of a nature that the lower section 12 gradually reduces its horizontal rectangular cross-sectional area in the direction of discharge of bulk material from the lower section 12. By virtue of the configuration of the bin 10 and, particularly, the rectangular horizontal cross-sectional areas thereof, there is no pinch angle between the upper section 11 and the lower section 12 of the bin 10.

In the exemplary embodiment, the sloping walls 21 and 22, respectively, slope generally at an angle of thirty-five degrees with respect to the uppermost horizontal, rectangular cross-sectional area 20 of the lower section 12. The sloping angle of the sloping walls 21 and 22 may vary dependent on the bulk material in the bin 10. In the preferred embodiment, the angle of the slope of sloping walls 21 and 22, respectively, measured from the vertical, provides no landing or support for the bulk material therebetween, because the inner surfaces thereof are smooth and the angle of the sloping walls 21 and 22, respectively, is steeper than the angle on which the dry powder material or granules can rest on a sloping surface. An angle steeper than an angle of a sloping surfaces on which the bulk material can rest is known as the angle of repose.

In the exemplary embodiment, the opposing vertical walls 23 and 24 of the lower section 12 are continuations of the respective coextensive vertical walls of the upper vertical walls of the upper section 11. The lower edges 16 of the upper section 11 seat on the upper edges 20 of the lower section 12 and are secured thereto in a suitable manner, such as welding, so as to provide a smooth change of direction for the bulk material stored in the bin 10.

Disposed in the lower section 12 of the bin 10 is a vertical bulk material deflecting wall or hopper divider 25 (FIGS. 1, 3 and 4) that is secured to vertical walls 23 and 24 of the lower section 12 by suitable means, such as welding. The vertical deflecting wall 25 extends from the uppermost horizontal, rectangular cross-sectional area of the lower section 12 and terminates in spaced relation to a lower wall 26 of the lower section 12 (FIGS. 1, 3 and 4). The lower wall 26 surrounds a reactangular discharge opening 27 (FIG. 3). In the preferred embodiment, the vertical deflecting wall 25 has a planar configuration and has flat, vertical surfaces confronting, respectively, the sloping walls 21 and 22.

The vertical bulk material deflecting wall 25, the sloping walls 21 and 22, and the vertical walls 23 and 24 form bulk material discharge compartments 30 and 31 (FIGS. 3 and 4). Hence, each discharge compartment is configured by three vertical walls and one sloping wall. By virtue of the configuration of each compartment, the mass flow of the bulk material in the bin 10 is discharged through the bin 10 with reduced bridging and without the employment of a vibrator. With the sloping angle of the sloping walls 23 and 24, respectively, greater than the angle of repose of dry powder material or granules in the bin 10, the dry powder bulk material or granules flows freely through the discharge opening 27 of the lower section 12 and reduces the compressive forces between the inner walls of the discharge compartments 30 and 31 without the employment of a vibrator for unloading the bulk material through the discharge opening 27.

In the examplary embodiment, a manually movable cam lock slide door or gate 32 (FIGS. 1, 3 and 4) is disposed below the discharge opening 27 of the lower section 12 for controlling the flow of bulk material through the discharge opening 27. Secured to the bottom wall 26 of the lower section 12 and surrounding the discharge opening 27 is a door support structure 35. The door support structure 35 is secured to the bottom of the sloping walls 21 and 22 of the lower bin 12 in a suitable manner, such as by welding. Additionally, rods 47 and 48 are welded to the door support structure 35 and a skid 45 for supporting the door support structure 35. In a like manner, rods 49 and 50 are welded to the door support structure 35 and a skid 46.

A suitable horizontal channel 55 (FIG. 3) is formed in the door support structure 35 to accommodate the rectilinear movement of the door 32. There is a close fit sealing engagement through a suitable seal 55*a* between the sliding door 32 and the door support structure 35 to control the flow of bulk material through the discharge opening 27. Extending through the channel 55 transversely thereof and extending outwardly from the support structure 35 are cam levers 32*a*. The cam levers 32*a* are spaced apart between the vertical walls 22 and 23 of the lower section 12. Each cam lever 32*a* includes a cam 32*b* (FIG. 3) disposed transversely of the channel 55. Each cam lever 32*a* is journalled for rotation relative to the sliding door support structure 35 by suitable bearings, such as the bearings 32*c* shown in FIG. 3. By rotating the cam levers 32*a* in one direction, after the door 32 is moved over a rectilinear path below the discharge opening 27, the cams 32*b* lift the sliding door upwardly to prevent the flow of powder bulk material from the discharge opening 27. By rotating the cam levers 32*a* in an opposite direction enables the door 32 to be lowered and moved over a rectilinear path in a longitudinal direction removed from the discharge opening 27 to permit powder bulk material or granules to be discharged from the lower section 12. At one end of the sliding door 32 is a flange 32*c* that enables the sliding door 32 to be gripped for imparting rectilinear movement to the sliding door 32. When the flange 32*c* engages the door support structure 35, the sliding door 32 is completely below the discharge opening 27 to enable the sliding door to prevent the flow of bulk material from the lower section 12.

Depending from the upper section 11 of the sloping walls 21 and 22 of the lower section 12 are four legs, only legs 40, 41 and 43 are shown (FIGS. 1–4), made of suitable material such as stainless steel. The legs, at the top thereof, are secured to the upper section of the sloping walls 21 and 22 in a suitable manner, such as by welding. Skid 45 is secured to the lower ends of legs 40 and 43. A skid is secured to the lower ends of the remaining legs. Shoe 61 is secured to the underside of the skid in a suitable manner, such as by welding. Shoe 61*a* is secured to the skid in a suitable manner, such as by welding. The skids 45 and 46 have rectangular cross-sectional areas and are configured to receive the tines, not shown, of a conventional fork lift truck. It is apparent that conventional casters or wheels may be mounted on the skids 45 and 46 in lieu of the blocks 61 and 61*a*.

What is claimed is:

1. A bulk material bin comprising:

(a) an upper section for storing bulk material;

(b) a lower section disposed below and in communication with said upper section for receiving bulk material from said upper section and for discharging bulk material from said bin, (c) said lower section being formed with oppositely directed, downwardly sloping walls joined by opposing vertical walls; and (d) a planar vertical divider disposed in said lower bin connected to said opposing vertical walls, said vertical planar divider including flat, vertical opposing surfaces confronting, respectively, said oppositely directed, downwardly sloping walls for reducing bridging of bulk material in said bin during the mass flow of the bulk material within said bin.

2. A bulk material bin as claimed in claim 1 wherein said upper section is configured to form rectangular horizontal cross-sectional areas and said lower section is configured to form rectangular horizontal cross-sectional areas decreasing in dimension in the direction of flow of bulk material through said lower section.

3. A bulk material bin as claimed in claim 2 wherein said lower section is formed with a bulk material discharge opening, said bulk material bin further comprising:

(a) a slide door disposed below said bulk material discharge opening; and (b) slide door support means attached to said oppositely directed, downwardly sloping walls, said slide door support means supported by said lower section and supporting said slide door for movement over a rectilinear path, said slide door support means being formed with a horizontal channel to receive said slide door for movement over a rectilinear path to control the flow of bulk material through said discharge opening.

4. A bulk material bin as claimed in claim 1 wherein said lower bin includes a horizontal, rectangular uppermost cross-sectional area and each of said oppositely directed, downwardly sloping walls slopes at an angle generally of 35° relative to said horizontal, rectangular uppermost cross-sectional area.

5. A bulk material bin comprising:

(a) an upper section for storing bulk material;

(b) a lower section comprising a compartment, said compartment being disposed below and in communication with said upper section for receiving bulk material from said upper section and for discharging bulk material from said bin, (c) said compartment being formed with a downwardly sloping wall joined by opposing vertical walls, and (d) a planar vertical bulk material deflecting wall connected at its ends to said opposing vertical walls and having a flat, vertical deflection surface confronting said downwardly sloping wall for reducing bridging of said bulk material in said bin during the mass flow of bulk material within said bin.

6. A bulk material bin as claimed in claim 5 wherein said upper section is configured to form rectangular horizontal cross-sectional areas and said compartment is configured to form rectangular horizontal cross-sectional areas decreasing in dimension in the direction of flow of bulk material through said compartment.

7. A bulk material discharge bin as claimed in claim 5 wherein said compartment communicates with a discharge opening, said bulk material bin further comprising a slide door disposed below said discharge opening; and slide door support means supported by said lower section, said slide door support means supporting said slide door for movement over a rectilinear path and being formed with a horizontal channel to receive said slide door for movement over the rectilinear path to control the flow of bulk material through said discharge opening.

8. A bulk material bin as claimed in claim 5 wherein said lower bin includes a horizontal, rectangular uppermost cross-sectional area, and said downwardly sloping wall declines generally at an angle of 35° relative to said horizontal, rectangular uppermost cross-sectional area.

9. A bulk material bin as claimed in claim 3 wherein said slide door support means comprises camming means for cam locking said sliding door when said slide door is disposed below said discharge opening.

10. A bulk material discharge bin as claimed in claim 7 wherein said slide door support means comprises camming means for cam locking said slide door when said slide door is disposed below said discharge opening.

11. A bulk material bin as claimed in claim 1 wherein each of said oppositely directed, downwardly sloping walls slope at an angle greater than the angle of repose of the material in said bin.

12. A bulk material bin as claimed in claim 5 wherein said downwardly sloping wall slopes at an angle greater than the angle of repose of the material in said bin.

* * * * *